US011650524B2

(12) United States Patent
Yamazoe

(10) Patent No.: US 11,650,524 B2
(45) Date of Patent: May 16, 2023

(54) FIXING DEVICE AND IMAGE FORMING APPARATUS

(71) Applicant: TOSHIBA TEC KABUSHIKI KAISHA, Tokyo (JP)

(72) Inventor: Atsushi Yamazoe, Fuji Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 42 days.

(21) Appl. No.: 17/341,560

(22) Filed: Jun. 8, 2021

(65) Prior Publication Data

US 2021/0294248 A1 Sep. 23, 2021

Related U.S. Application Data

(63) Continuation of application No. 16/924,727, filed on Jul. 9, 2020, now Pat. No. 11,054,768, which is a (Continued)

(51) Int. Cl.
*G03G 15/20* (2006.01)
*G03G 15/08* (2006.01)

(52) U.S. Cl.
CPC ..... *G03G 15/2017* (2013.01); *G03G 15/206* (2013.01); *G03G 15/2053* (2013.01); *G03G 15/2057* (2013.01); *G03G 15/2064* (2013.01); *G03G 15/0818* (2013.01); *G03G 2215/2035* (2013.01); *G03G 2215/2038* (2013.01)

(58) Field of Classification Search
CPC ..... G03G 15/2017; G03G 15/2025; G03G 2215/2035
See application file for complete search history.

(56) References Cited

U.S. PATENT DOCUMENTS

| | | | |
|---|---|---|---|
| 8,447,221 | B2 | 5/2013 | Hasegawa |
| 9,261,832 | B2 | 2/2016 | Muramatsu et al. |
| 2020/0133175 | A1 | 4/2020 | Yamazoe |

FOREIGN PATENT DOCUMENTS

| | | | |
|---|---|---|---|
| JP | 2004-109878 | A | 4/2004 |
| JP | 2004-191744 | A | 7/2004 |
| JP | 2015-069094 | A | 4/2015 |

OTHER PUBLICATIONS

Matsuno, Fixing Device and Fixing Belt, Apr. 2015, JPO Computer Translation (Year: 2015).*

(Continued)

*Primary Examiner* — Erika J. Villaluna
(74) *Attorney, Agent, or Firm* — Foley & Lardner LLP

(57) ABSTRACT

A fixing device includes a fixing rotating member, a heater, a fixing pad, a pressurizing member, a lubricant, and a surface layer. The fixing rotating member is configured to fix a toner image on a recording medium and is heated by the heater. The fixing pad is positioned on an inner circumferential side of the fixing rotating member, and presses the fixing rotating member from the inner circumferential side. The pressurizing member faces an outer circumferential surface of the fixing rotating member, and forms a nip for fixing between the pressurizing member and the fixing rotating member. The lubricant is applied to the fixing rotating member. The surface layer is disposed in a vicinity of an end portion of a pressurizing surface of the fixing pad and returns the lubricant to a longitudinal central side of the pressurizing surface.

18 Claims, 6 Drawing Sheets

Related U.S. Application Data continuation of application No. 16/172,442, filed on Oct. 26, 2018, now Pat. No. 10,732,548.

(56) References Cited

OTHER PUBLICATIONS

Final Office Action on U.S. Appl. No. 16/924,727 dated Dec. 24, 2020.
Non-Final Office Action on U.S. Appl. No. 16/924,727 dated Sep. 10, 2020.
Notice of Allowance dated Apr. 2, 2020 in U.S. Appl. No. 16/172,442 (US 2020-0133175).
Notice of Allowance on U.S. Appl. No. 16/924,727 dated Mar. 5, 2021.
Office Action dated Apr. 4, 2019, in U.S. Appl. No. 16/172,442 (US 2020-0133175).
Office Action dated Oct. 22, 2019 in U.S. Appl. No. 16/172,442 (US 2020-0133175).

* cited by examiner

FIXING DEVICE AND IMAGE FORMING APPARATUS

CROSS-REFERENCE TO RELATED APPLICATIONS

This application is a continuation of U.S. application Ser. No. 16/924,727 filed Jul. 9, 2020, which is a continuation of U.S. application Ser. No. 16/172,442 filed Oct. 26, 2018, now U.S. Pat. No. 10,732,548. The entire contents of the applications identified above are incorporated herein by reference.

FIELD

Embodiments described herein relate generally to a fixing device and an image forming apparatus.

BACKGROUND

An image forming apparatus such as a multi function peripheral (MFP), a copying machine, or a printer includes a fixing device that fixes a toner image transferred on a recording medium such as recording paper. The fixing device includes a fixing rotating member such as a fixing belt that rotates in contact with the recording medium, a fixing pad that is disposed on an inner circumferential side of the fixing rotating member, and a pressurizing member such as a press roller that is disposed so as to face an outer circumferential surface of the fixing rotating member. The pressurizing member is pressed toward the fixing pad interposing a circumferential wall of the fixing rotating member therebetween. The pressurizing member and the fixing rotating member rotate in opposite directions, and a fixing nip is formed between the pressurizing member and the fixing rotating member. The recording medium such as recording paper is drawn by the fixing nip between the pressurizing member and the fixing rotating member, and fixing is performed as the recording medium passes through the fixing nip.

DETAILED DESCRIPTION

In some fixing devices, since the fixing pad is pressed against an inner circumferential surface of the fixing rotating member, sliding resistance is generated between the fixing pad and the inner circumferential surface of the fixing rotating member during the fixing operation. As the sliding resistance increases, power loss of a drive unit such as the fixing rotating member increases, and problems such as abrasion of components, occurrence of wrinkles on a recording medium, deterioration in printing quality, and the like tend to occur.

As a countermeasure, a fixing device in which a lubricant is applied to the inner circumferential surface of the fixing rotating member is devised. However, the circumferential wall of the fixing rotating member is pushed in between the pressurizing member and the fixing pad with relatively large power during the fixing operation. Accordingly, it is possible that the lubricant applied to the inner circumferential surface of the fixing rotating member leaks to outside from an end portion of fixing rotating member in a longitudinal direction during the fixing operation.

Therefore, there is a demand for a fixing device that can suppress leaking of a lubricant applied to an inner circumferential surface of a rotating member and maintain a suppression effect of sliding resistance for a long period of time.

In general, according to one embodiment, there is provided a fixing device including a fixing rotating member, a heater, a fixing pad, a pressurizing member, a lubricant, and a surface layer. The fixing rotating member is rotatably configured to fix a toner image on a recording medium. The heater heats the fixing rotating member. The fixing pad is positioned on an inner circumferential side of the fixing rotating member, and presses the fixing rotating member from the inner circumferential side. The pressurizing member is disposed to face an outer circumferential surface of the fixing rotating member, and forms a nip for fixing between the pressurizing member and the fixing rotating member at a position facing the fixing pad. The lubricant is applied to an inner circumferential surface of the fixing rotating member. The surface layer is disposed in a vicinity of a longitudinal end portion of a pressurizing surface of the fixing pad in the inner circumferential surface of the fixing rotating member, and returns the lubricant to a longitudinal central side of the pressurizing surface.

Hereinafter, an image forming apparatus of at least one embodiment will be described with reference to drawings.

First Embodiment

Figure 1:
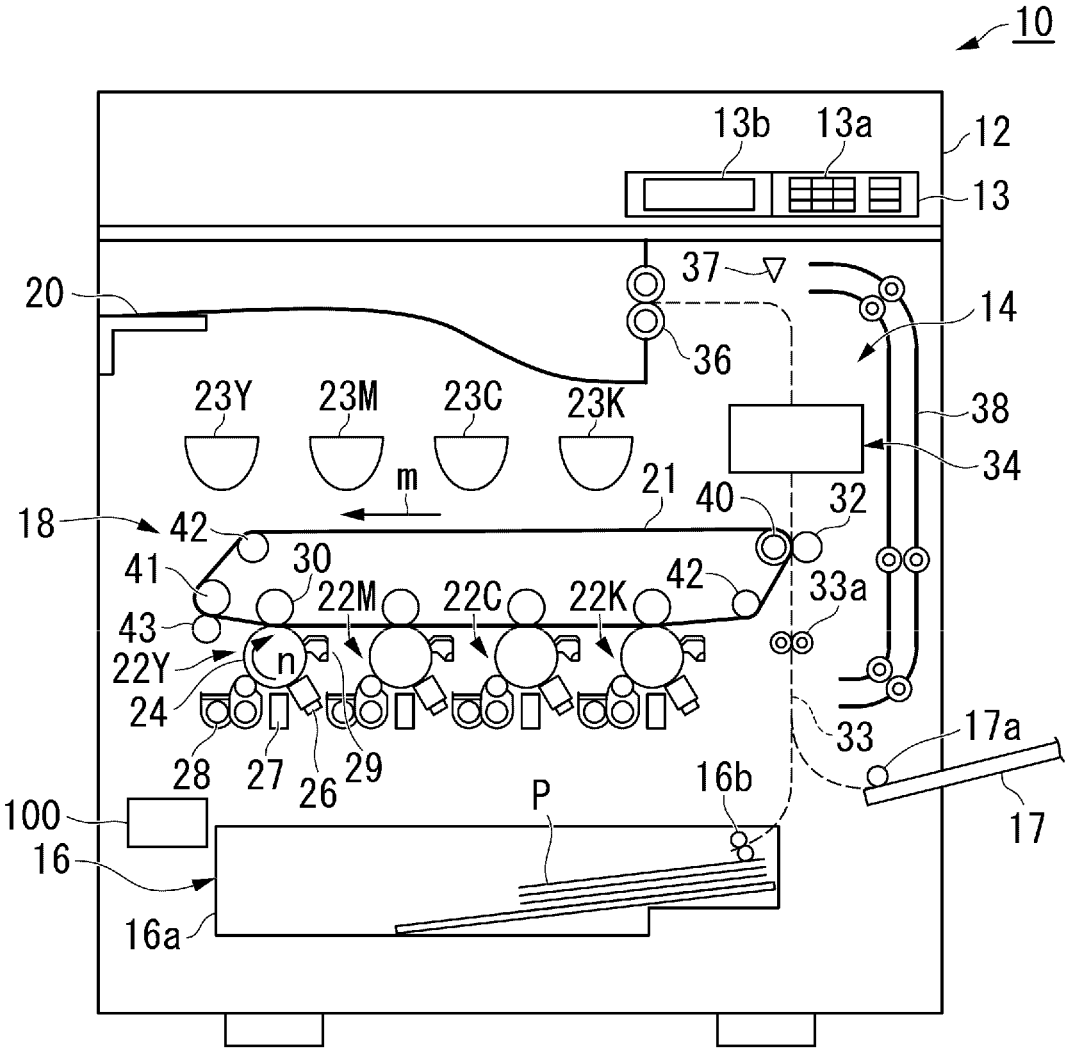
FIG. 1 is a side view of an image forming apparatus including a fixing device of at least one embodiment.

FIG. 1 is a side view showing an entire configuration of an image forming apparatus 10 of at least one embodiment. For example, the image forming apparatus 10 is a multi function peripheral. However, the image forming apparatus 10 is not limited to the above-described example, and may be a copying machine, a printer, or the like.

The image forming apparatus 10 includes a scanner unit 12, a control panel 13, a main unit 14, and a system control unit 100 (a system controller). The main unit 14 includes a paper feed cassette unit 16, a printer unit 18, a fixing device 34, and the like. The system control unit 100 controls the entire image forming apparatus 10. For example, the system control unit 100 controls operations of the scanner unit (scanner) 12, the control panel 13, the paper feed cassette unit 16, the printer unit (printer) 18, the fixing device (fixer) 34, and the like.

The scanner unit 12 reads an original image. The control panel 13 includes an input key 13*a* and a display unit 13*b*. For example, the input key 13*a* receives an input from a user. For example, the display unit 13*b* is a touch panel type. The display unit 13*b* receives the input from a user, and displays to the user.

The paper feed cassette unit 16 includes a cassette body 16*a* and a pickup roller 16*b*. The cassette body 16*a* stores a sheet P which is a recording medium. The pickup roller 16*b* takes out the sheet P from the cassette body 16*a*. The sheet P taken out from the cassette body 16*a* is fed to a carrying path 33.

The printer unit 18 forms an image on the sheet P. The printer unit 18 performs, for example, image formation of the original image read by the scanner unit 12. The printer unit 18 includes an intermediate transfer belt 21. The printer unit 18 supports the intermediate transfer belt 21 with a backup roller 40, a driven roller 41, and a tension roller 42. The backup roller 40 includes a drive unit (not shown). The printer unit 18 rotates the intermediate transfer belt 21 in an arrow m direction.

The printer unit 18 includes four sets of image forming stations 22Y, 22M, 22C, and 22K. Each of the image forming stations 22Y, 22M, 22C, and 22K is used for image formation of each Y (yellow) image, M (magenta) image, C (cyan) image, and K (black) image. The image forming stations 22Y, 22M, 22C, and 22K are disposed in parallel along a rotation direction of the intermediate transfer belt 21 on a lower side of the intermediate transfer belt 21.

The printer unit 18 includes cartridges 23Y, 23M, 23C, and 23K above the image forming stations 22Y, 22M, 22C, and 22K, respectively. Each of the cartridges 23Y, 23M, 23C, and 23K stores a toner for replenishment of Y (yellow), M (magenta), C (cyan), and K (black), respectively.

Hereinafter, among each of the image forming stations 22Y, 22M, 22C, and 22K, the image forming station 22Y of Y (yellow) will be described as an example. Since the image forming stations 22M, 22C, and 22K have the same configuration as the image forming station 22Y, a detailed description will be omitted.

The image forming station 22Y includes an electrifying charger 26, an exposure scanning head 27, a developing device 28, and a photoconductive cleaner 29. The electrifying charger 26, the exposure scanning head 27, the developing device 28, and the photoconductive cleaner 29 are disposed around a photoconductive drum 24 that rotates in an arrow n direction.

The image forming station 22Y includes a primary transfer roller 30. The primary transfer roller 30 faces the photoconductive drum 24 via the intermediate transfer belt 21.

The image forming station 22Y electrifies the photoconductive drum 24 with the electrifying charger 26, and exposes the photoconductive drum 24 by the exposure scanning head 27. The image forming station 22Y forms an electrostatic latent image on the photoconductive drum 24. The developing device 28 develops the electrostatic latent image on the photoconductive drum 24 using two-component developer formed of toner and a carrier.

The primary transfer roller 30 primarily transfers the toner image formed on the photoconductive drum 24 to the intermediate transfer belt 21. The image forming stations 22Y, 22M, 22C, and 22K form a color toner image on the intermediate transfer belt 21 by the primary transfer roller 30. The color toner image is formed by overlapping the toner images of Y (yellow), M (magenta), C (cyan), and K (black) in sequence. The photoconductive cleaner 29 removes the toner left on the photoconductive drum 24 after the primary transfer.

The printer unit 18 includes a secondary transfer roller 32. The secondary transfer roller 32 faces the backup roller 40 via the intermediate transfer belt 21. The secondary transfer roller 32 collectively secondarily transfers the color toner image on the intermediate transfer belt 21 on the sheet P. The sheet P is fed by the paper feed cassette unit 16 or a manually feeding tray 17 along the carrying path 33.

The printer unit 18 includes a belt cleaner 43 facing the driven roller 41 via the intermediate transfer belt 21. The belt cleaner 43 removes the toner left on the intermediate transfer belt 21 after the secondary transfer.

The carrying path 33 is provided with a resist roller 33*a*, the fixing device 34, and a paper discharge roller 36. On a downstream side of the fixing device 34 of the carrying path 33, a branch portion 37 and a reverse carrying portion 38 are provided. The branch portion 37 sends the sheet P subjected to fixing to a paper discharging portion 20 or the reverse carrying portion 38. In a case of double-sided printing, the reverse carrying portion 38 inverts and carries the sheet P sent from the branch portion 37 in a direction of the resist roller 33*a*. The image forming apparatus 10 forms a toner image on the sheet P with the printer unit 18, and discharges the sheet P to the paper discharging portion 20.

The image forming apparatus 10 is not limited to a tandem development type, and the number of the developing devices 28 is not limited. Furthermore, the image forming apparatus 10 may directly transfer the toner image from the photoconductive drum 24 on the sheet P.

Hereinafter, the fixing device 34 will be described in detail.

Figure 2:
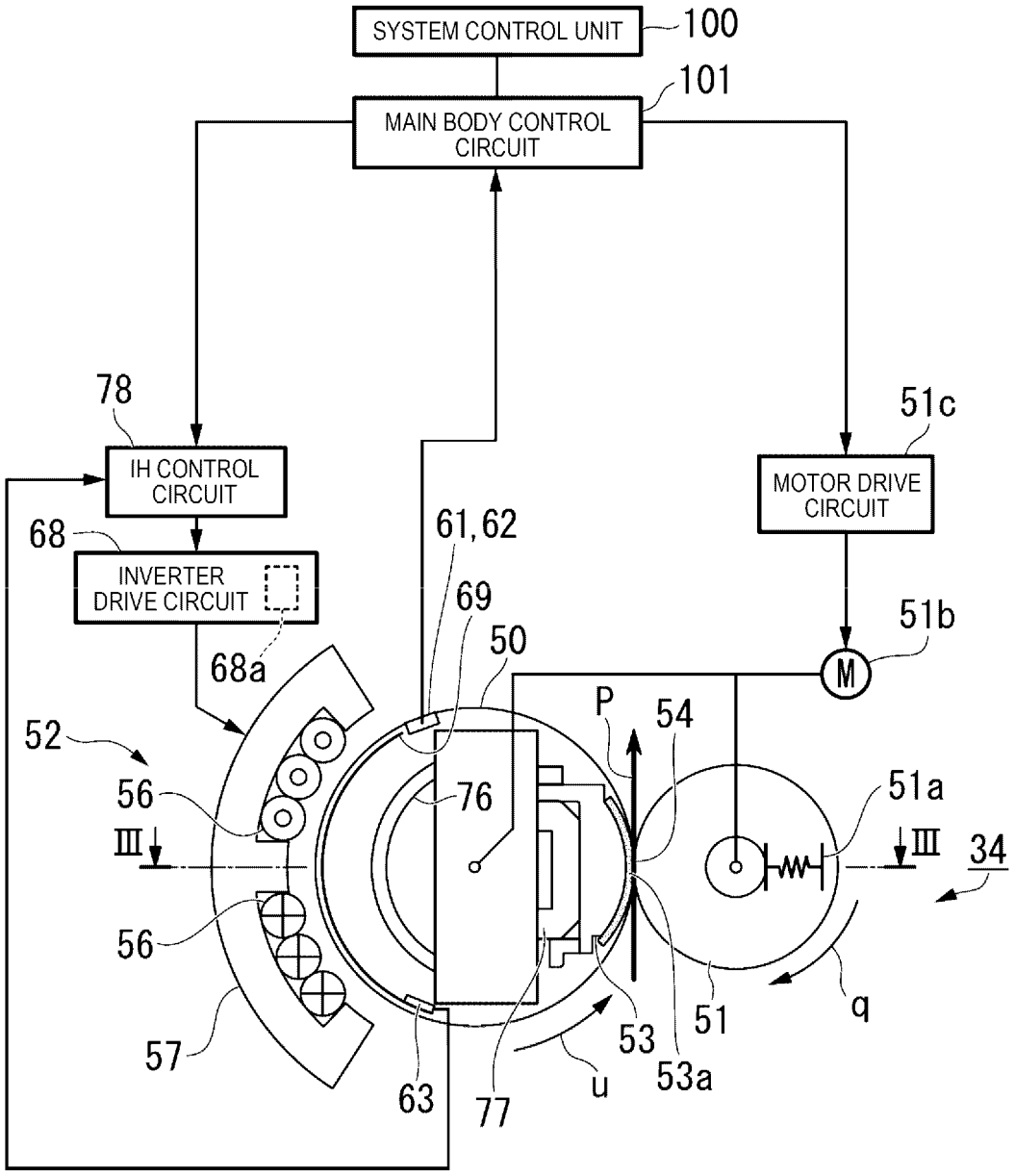
FIG. 2 is a partial section side view including a control block of the fixing device of at least one embodiment.

FIG. 2 is a partial section side view including a control block of the fixing device 34 of at least one embodiment.

As shown in FIG. 2, the fixing device 34 includes a fixing belt 50, a press roller 51, and an electromagnetic induction heating coil unit 52 (hereinafter, referred to as IH coil unit 52). The fixing belt 50 makes up the fixing rotating member. The press roller 51 makes up the pressurizing member (pressurizer). The IH coil unit 52 makes up the heater that heats the fixing belt 50 (fixing rotating member). As a heater that heats the fixing belt 50 (fixing rotating member), it is possible to use a halogen heater or the like instead of the IH coil unit 52. On an inner circumferential side of the fixing belt 50, a nip pad 53 (fixing pad), an auxiliary heat generation plate 69, a shield 76, and a stay 77 for holding them is disposed. On the inner circumferential side of the fixing belt 50, a center thermistor 61, an edge thermistor 62, and a bimetal type thermostat 63 are disposed close to an inner circumferential surface of the fixing belt 50.

The fixing belt 50 is driven by the press roller 51, or rotates in an arrow u direction independently from the press roller 51.

The fixing belt 50 is formed by laminating a heat generation layer (heat generation portion), a cushion layer, a release layer, and the like on a base layer in order. The base layer is formed of, for example, a polyimide (PI) resin. The heat generation layer is formed of non-magnetic metal such as copper (Cu). The cushion layer is formed of, for example, a solid rubber such as a silicone rubber. The release layer is formed of, for example, a fluororesin such as a tetrafluoroethylene-perfluoroalkylvinylether copolymer resin (PFA).

An eddy-current is generated by the magnetic flux generated by the IH coil unit 52 in the heat generation layer inside the fixing belt 50. The heat generation layer generates Joule heat according to the eddy-current generated at the time and a resistance value of the heat generation layer, and heats the entire fixing belt 50.

The IH coil unit 52 includes coils 56 that generate a magnetic flux by application of a high frequency current and a core 57 that concentrates the magnetic flux generated by the coils 56 in a direction of the fixing belt 50. During the fixing belt 50 rotates in the arrow u direction in FIG. 2, the IH coil unit 52 generates an induced current to the heat generation layer inside the fixing belt 50 facing the IH coil unit 52. The coil 56 generates a magnetic flux by application of a high frequency current from an inverter drive circuit 68. The inverter drive circuit 68 includes, for example, an insulated gate bipolar transistor (IGBT) element 68*a*.

The auxiliary heat generation plate 69 is disposed slidably abutted or close to the inner circumferential surface of the fixing belt 50. The auxiliary heat generation plate 69 is formed of a magnetic shunt alloy in which the magnetic characteristics change by a temperature. When a temperature of the auxiliary heat generation plate 69 is the Curie temperature or higher, magnetic permeability is reduced. Accordingly, magnetic flux density passing through the fixing belt 50 decreases, and the amount of heat generated by the fixing belt 50 is limited. As a result, for example, it is possible to suppress excessive temperature rise in a non-paper passing region in the fixing belt 50. Moreover, in a low temperature region where the temperature does not reach the Curie temperature, the auxiliary heat generation plate 69 is electromagnetically induced by an action of a magnetic field of the IH coil unit 52 to generate heat, and helps the heating of the fixing belt 50.

The auxiliary heat generation plate 69 is formed in an arc shape along the inner circumferential surface of the fixing belt 50 as seen from an outer side of the fixing belt 50 in the longitudinal direction. The auxiliary heat generation plate 69 is disposed to face the core 57 with a circumferential wall of the fixing belt 50 interposed therebetween. Moreover, a length of the auxiliary heat generation plate 69 in a longitudinal direction is set longer than a maximum width of the sheet P to be used. The auxiliary heat generation plate 69 has, for example, the same longitudinal length as the nip pad 53. A width direction of the sheet P (recording medium) means a direction along the longitudinal direction of the fixing belt 50 when the sheet P is pressed against an outer surface of the fixing belt 50 by a nip 54.

The shield 76 is formed in an arc shape along the inner circumferential surface of the fixing belt 50 as seen from the outer side of the fixing belt 50 in the longitudinal direction. The shield 76 is disposed spaced apart on an inner side of the auxiliary heat generation plate 69 in the radial direction. The shield 76 is made of, for example, a non-magnetic member such as aluminium (Al), copper (Cu), or the like. The shield 76 shields the magnetic flux generated from the IH coil unit 52, and prevents the magnetic flux from affecting the stay 77 on the inner circumferential surface of the fixing belt 50, the nip pad 53, and the like.

The nip pad 53 presses the inner circumferential surface of the circumferential wall of the fixing belt 50 toward the press roller 51 side to form the nip 54 for fixing between the fixing belt 50 and the press roller 51. The nip pad 53 is formed of, for example, a heat resistant polyphenylene sulfide resin (PPS), a liquid crystal polymer (LCP), a phenol resin (PF), or the like. At a portion (pressurizing surface) that comes into contact with the inner circumferential surface of the fixing belt 50 in the nip pad 53, a sheet 53*a* (low friction member) having good sliding property and good abrasion resistance is attached. At the portion (pressurizing surface) that comes into contact with the inner circumferential surface of the fixing belt 50 in the nip pad 53, a release layer formed of a fluororesin or the like may be provided. Accordingly, it is possible to reduce friction resistance between the fixing belt 50 and the nip pad 53.

The press roller 51 includes, for example, a heat resistant silicone sponge or a silicone rubber around a core bar, and a release layer formed of fluororesin or the like on the surface. The press roller 51 pressurizes, for example, the nip pad 53 with a pressurization mechanism 51*a*. The press roller 51 rotates in an arrow q direction in FIG. 2 by driving force of a motor 51*b*. The motor 51*b* is driven by a motor drive circuit 51*c* that is controlled by a main body control circuit 101.

The center thermistor 61 and the edge thermistor 62 measures a temperature of the fixing belt 50, and outputs a detection signal to the main body control circuit 101. The center thermistor 61 is disposed at a substantially central portion in the longitudinal direction (width direction) of the fixing belt 50. The edge thermistor 62 is disposed in an end portion region on both sides in the longitudinal direction (width direction) of the fixing belt 50.

The main body control circuit 101 receives the detection signal from the center thermistor 61 and the edge thermistor 62, and controls the high frequency output current of the inverter drive circuit 68 through an IH control circuit 78. The temperature of the fixing belt 50 is maintained within various control temperature ranges according to the output of the inverter drive circuit 68.

The thermostat 63 functions as a safety device for the fixing device 34. The thermostat 63 operates when the temperature of the fixing belt 50 rises to a predetermined shutoff threshold or higher, and shuts off energization with respect to the IH coil unit 52. At this time, the image forming apparatus 10 stops driving to prevent abnormal heat generation of the fixing device 34.

Figure 3:
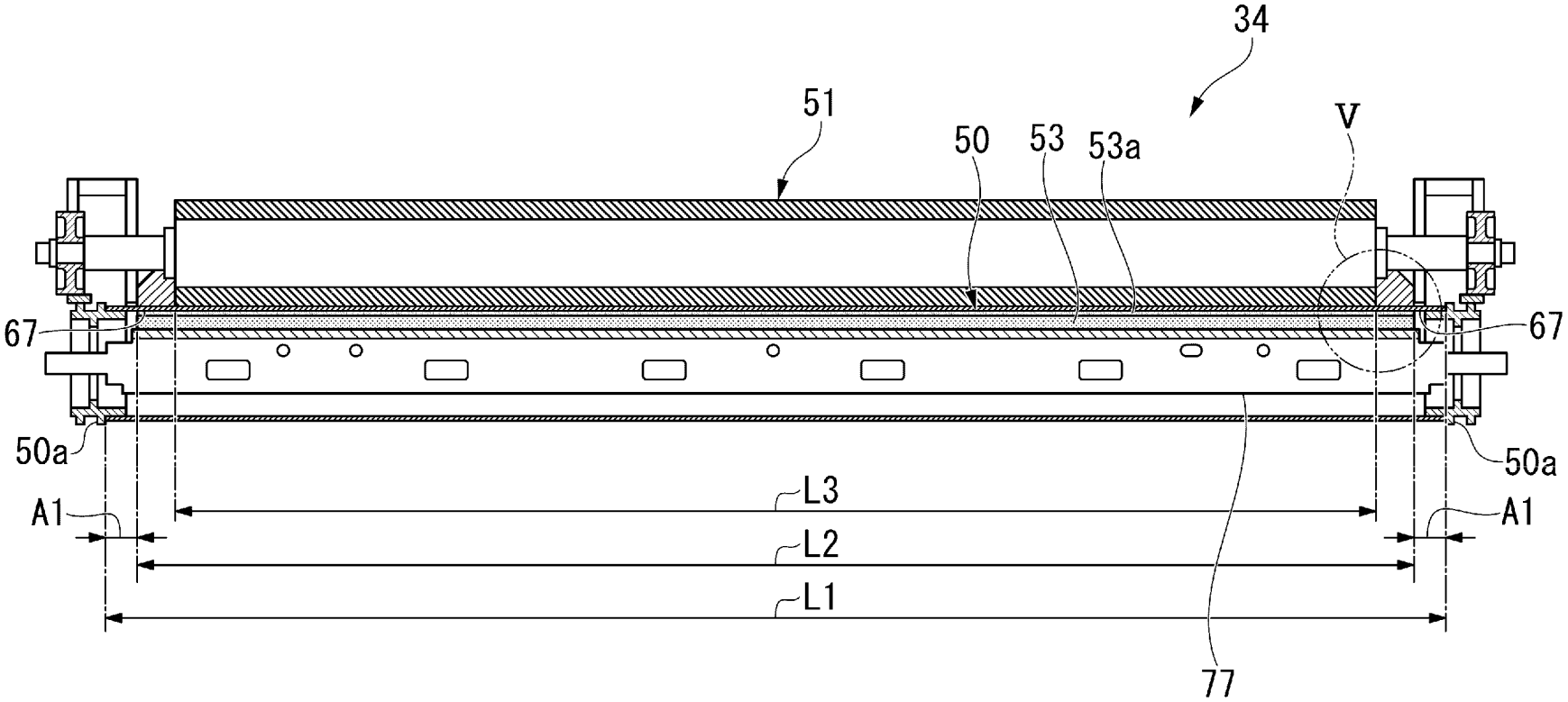
FIG. 3 is a cross-sectional view taken along line of FIG. 2 of the fixing device of at least one embodiment.
Figure 4:
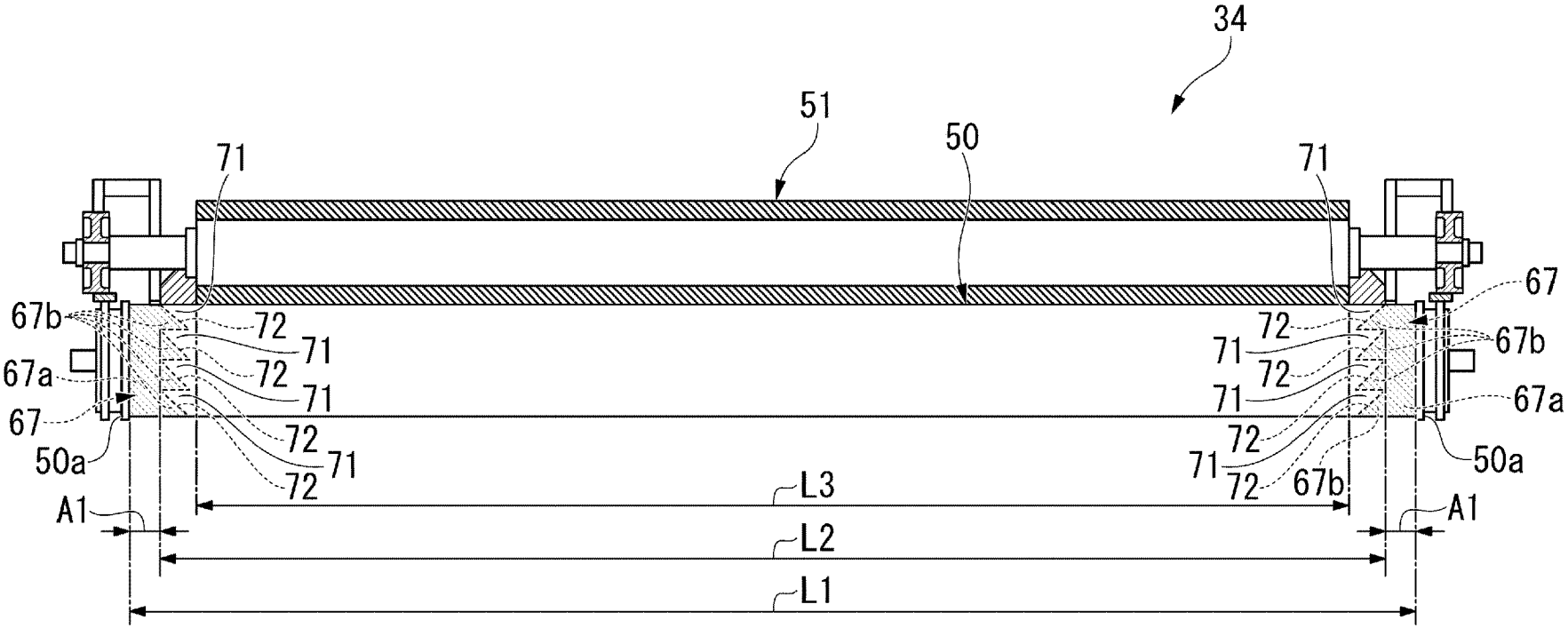
FIG. 4 is a cross-sectional view similar to FIG. 3 shown without showing a cross-section of a fixing belt.

FIG. 3 is a cross-sectional view taken along line of FIG. 2 of the fixing device 34. FIG. 4 is a cross-sectional view similar to FIG. 3 shown without sectioning the fixing belt 50.

As shown in FIGS. 3 and 4, a wheel 50*a* for keeping the cross-sectional shape of the fixing belt 50 substantially circular is attached on both end portions of the fixing belt 50 in the longitudinal direction. A longitudinal length L1 of the fixing belt 50 is set longer than longitudinal lengths L2 and L3 of the nip pad 53 (sheet 53*a*) and the press roller 51. The longitudinal length L2 of the nip pad 53 is set longer than the longitudinal length L3 of the press roller 51. That is, a longitudinal length of a pressing portion of the press roller 51 with respect to an outer circumferential surface of the fixing belt 50 is set shorter than the longitudinal length of a pressing portion of the nip pad 53 with respect to the inner circumferential surface of the fixing belt 50. An outer region A1 in a longitudinal end portion of the fixing belt 50 is not directly pressed from either the nip pad 53 or the press roller 51 than the nip pad 53.

Figure 5:
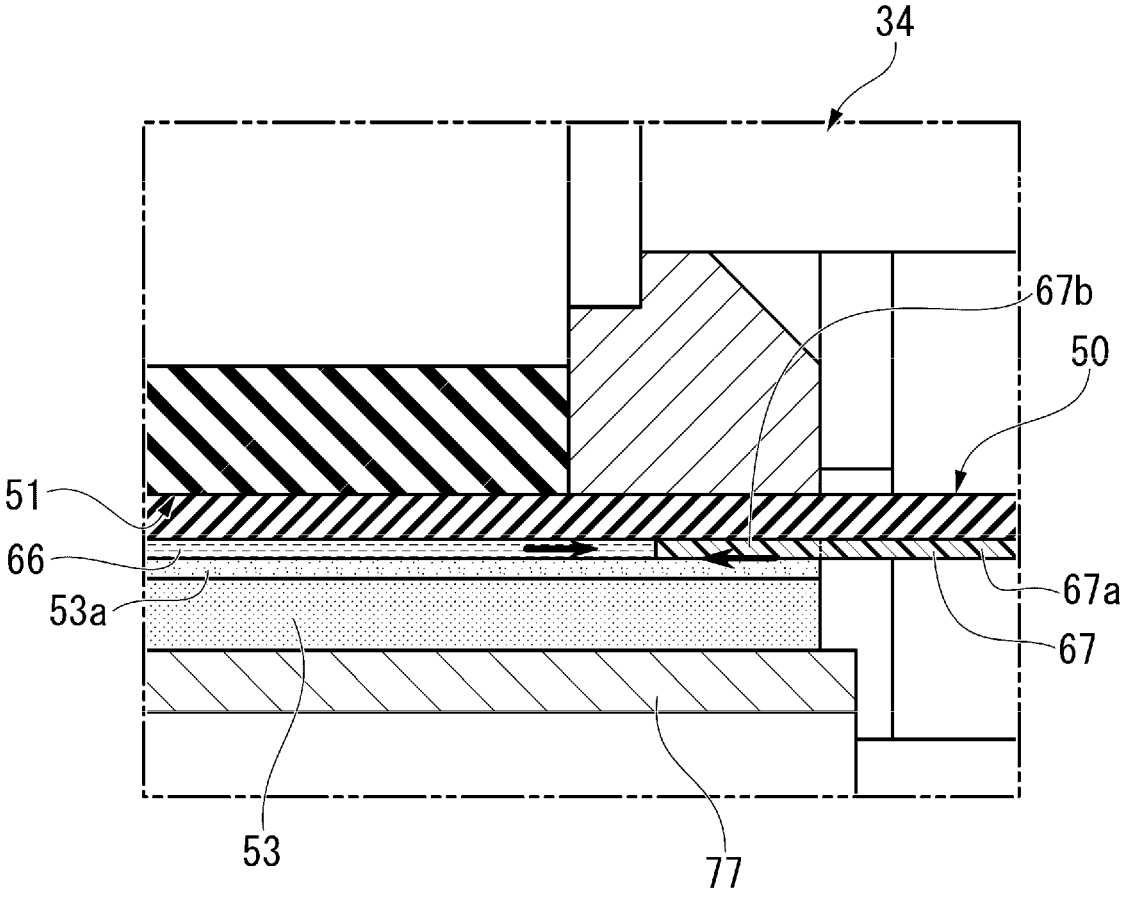
FIG. 5 is an enlarged sectional view of a V portion in FIG. 3.

FIG. 5 is an enlarged sectional view of a V portion in FIG. 3.

A lubricant 66 is applied to a region (region excluding vicinity of end portion in longitudinal direction) that comes into contact with the nip pad 53 (sheet 53*a*) and the auxiliary heat generation plate 69 in the inner circumferential surface of the fixing belt 50. As the lubricant 66, for example, silicone oil and the like can be used. As the silicone oil, for example, it is desirable to use a dimethyl silicone oil having kinetic viscosity at 25° C. 1,000 $mm^2/s$ or less. The viscosity of the silicone oil is measured, for example, using an Ubbelohde viscometer according to ASTM D 445-46T. The lubricant 66 reduces the friction resistance of the nip pad 53 (sheet 53*a*) and the auxiliary heat generation plate 69 that comes into contact with the inner circumferential surface of the fixing belt 50.

Moreover, the outer region A1 of the longitudinal direction and a region straddling a part inside from the outer region A1 in the inner circumferential surface of the fixing belt 50, is coated with a surface layer 67 formed of an oil repellent member such as polytetrafluoroethylene (PTFE) or perfluoroalkoxyalkane (PFA). The surface layer 67 formed of an oil repellent member functions to repel the lubricant 66 when the lubricant 66 such as silicone oil flows in. The outer region A1 of the longitudinal direction and the region straddling a part inside from the outer region A1 in the inner circumferential surface of the fixing belt 50 are disposed in a vicinity of a longitudinal end portion of the pressurizing surface of the nip pad 53 (fixing pad). The surface layer 67 functions to push the lubricant 66 trying to flow out from a longitudinal central region in a direction of the outer region A1 back to the longitudinal central region in the inner circumferential surface of the fixing belt 50.

As shown in FIG. 4, the surface layer 67 coated on the inner circumferential surface of the fixing belt 50 has an annular base portion 67*a* having a substantially constant width along a circumferential surface of the fixing belt 50 and a plurality of projection portions 67*b* having a substantially triangular shape provided in succession to the inner region of the base portion 67*a*. Each projection portion 67*b* may be formed in a substantially right triangular shape, although the projection portion 67*b* is not limited to such a shape. Each projection portion 67*b* has a base extending along a longitudinal direction of the fixing belt 50 and an inclined side inclined with respect to the base. A recessed portion surrounded by two adjacent projection portions 67*b* and the base portion 67*a* forms a trapping portion 71 that traps the lubricant trying to flow out to the end portion side from the longitudinal central region of the inner circumferential surface of the fixing belt 50. The inclined side of each projection portion 67*b* forms an inclined portion 72 that returns the lubricant 66 flowing into the trapping portion 71 back to the longitudinal central side of the inner circumferential surface of the fixing belt 50 with rotational movement of the fixing belt 50. The inclined portion 72 is inclined so as to push back the lubricant 66 in a forward direction in a rotation direction to the longitudinal central side of the fixing belt 50 at the time of rotational movement of the fixing belt 50.

The fixing device 34 performs fixing with respect to the sheet P on which a toner image is attached when the fixing belt 50 is heated to a predetermined temperature by application of high frequency current with respect to the IH coil unit 52. When the sheet P is carried to the fixing device 34, the sheet P is drawn by the nip 54 between the fixing belt 50 and the press roller 51, the sheet P is heated while the sheet is passing through the nip 54 and pressed by the press roller 51 and the nip pad 53. Accordingly, a toner imaged is fixed on the sheet P.

In the fixing device 34, while fixing is performed with respect to the sheet P as described above, the nip pad 53 comes into sliding contact with the inner circumferential surface of the fixing belt 50 via the low friction sheet 53*a* in a pressurized state. At this time, the auxiliary heat generation plate 69 also comes into sliding contact with the inner circumferential surface of the fixing belt 50. In the fixing device 34 of at least one embodiment, since the lubricant 66 is applied to the inner circumferential surface of the fixing belt 50, it is possible to suppress the sliding resistance between the inner circumferential surface of the fixing belt 50 with the nip pad 53 (sheet 53*a*) and the auxiliary heat generation plate 69 to a low level. Therefore, it is possible to suppress an increase in power loss of the fixing belt 50 and the drive unit of the press roller 51, and it is possible to suppress the abrasion of components such as the fixing belt 50, occurrence of wrinkles on the sheet P, deterioration in printing quality, and the like.

Since the nip pad 53 is pressed against the inner circumferential surface of the fixing belt 50 with great power during the fixing operation in the fixing device 34, the lubricant 66 applied to the inner circumferential surface of the fixing belt 50 tries to flow out to the longitudinal outer side of the fixing belt 50 gradually. However, in the fixing device 34 of at least one embodiment, the surface layer 67 formed of an oil repellent member is applied to the end portion of the longitudinal direction (vicinity of longitudinal end portion of the pressurizing surface of nip pad 53) in the inner circumferential surface of the fixing belt 50. Therefore, the lubricant 66 trying to flow out to the end portion side from the longitudinal central region of the fixing belt 50 is repelled by the surface layer 67 formed of an oil repellent member and returns to the central side of the fixing belt 50.

In particular, in the fixing device 34 of at least one embodiment, the surface layer 67 provided on the inner circumferential surface of the fixing belt 50 has the trapping portion 71 and the inclined portion 72, and it is possible to mechanically return the lubricant 66 to the longitudinal central side of the fixing belt 50 according to the rotational movement of the fixing belt 50. Accordingly, in the fixing device 34 of at least one embodiment, it is possible to efficiently return the lubricant 66 to the central region of the fixing belt 50 with oil repellency of the surface layer 67 and a return mechanism of the trapping portion 71 and the inclined portion 72. Therefore, in a case where the fixing device 34 of at least one embodiment is employed, it is possible to suppress the leakage of the lubricant 66 applied to the inner circumferential surface of the fixing belt 50, and maintain a suppression effect of sliding resistance of the inner circumferential surface of the fixing belt 50 for a long period of time.

The surface layer 67 provided on the inner circumferential surface of the fixing belt 50 can be made of a member other than an oil repellent member. In a case where the surface layer 67 is formed of an oil repellent member as in the fixing device 34 of at least one embodiment, it is possible to efficiently return the lubricant 66 to the longitudinal central region of the fixing belt 50.

In a case where the surface layer 67 is formed by coating an oil repellent member on the inner circumferential surface of the fixing belt 50 as in the fixing device 34 of at least one embodiment, the surface layer 67 becomes thin and occupied space on the inner circumferential side of the fixing belt 50 becomes small.

In the fixing device 34 of at least one embodiment, since the low friction sheet 53*a* is attached on the pressurizing surface of the nip pad 53, it is possible to further reduce the sliding resistance between the fixing belt 50 and the nip pad 53 during the fixing operation.

In the fixing device 34 of at least one embodiment, the surface layer 67 is provided in a non-pressurized region not directly pressurized by the press roller 51 in the fixing belt 50. Therefore, the surface layer 67 is pressed against the nip pad 53 by the press roller 51 with great power, and it is possible to suppress the surface layer 67 from peeling off from the inner circumferential surface of the fixing belt 50.

Second Embodiment

Figure 6:
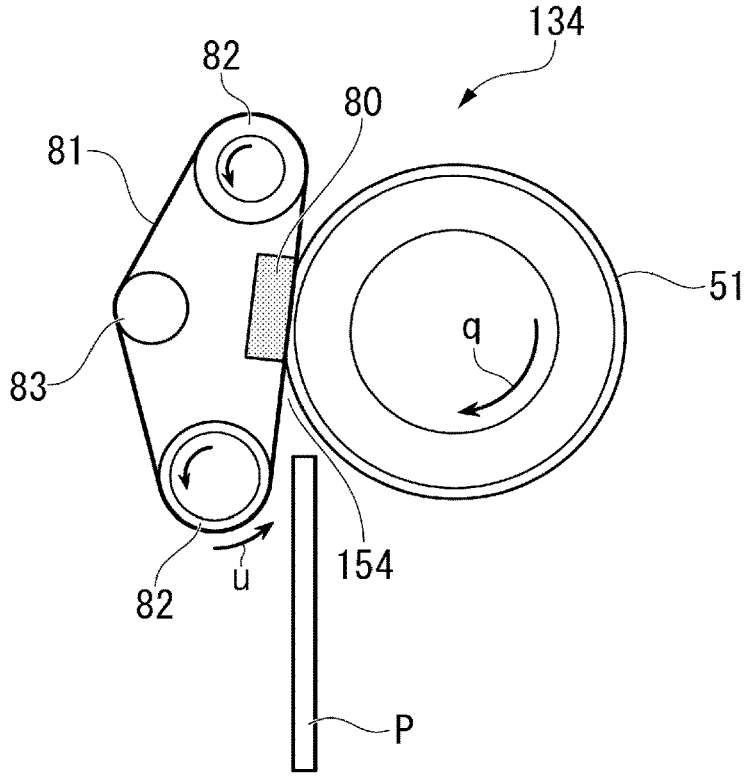
FIG. 6 is a partial section side view of a fixing device of another embodiment.
Figure 7:
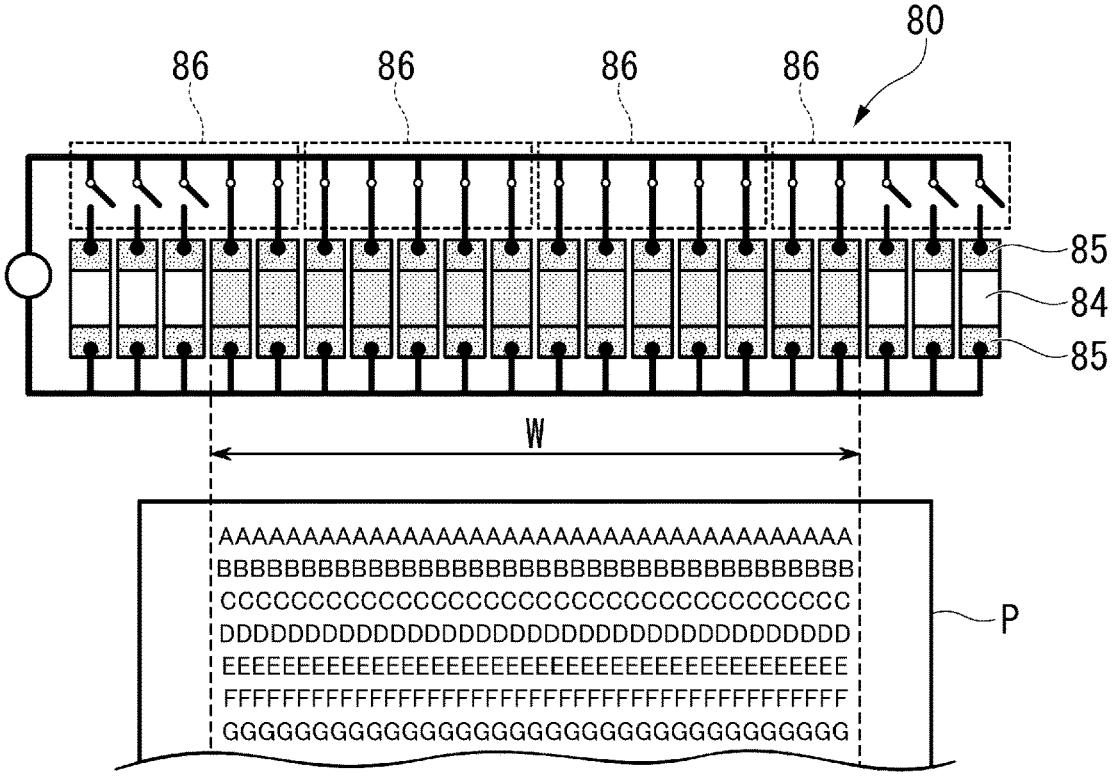
FIG. 7 is a view showing a relationship between a heating member and a printing region of a sheet of the fixing device of another embodiment.

FIG. 6 is a partial section side view of a fixing device 134 of another embodiment. FIG. 7 is a view showing a relationship between a heating member 80 and a printing region of the sheet P which is a recording medium in the fixing device 134 of another embodiment.

The fixing device 134 of at least one embodiment is applied to the image forming apparatus 10 shown in FIG. 1, for example, similarly to the above-described embodiment.

The fixing device 134 includes an endless belt 81, the press roller 51, and the heating member 80. The endless belt 81 makes up a rotating member rotating in an arrow u direction in FIG. 6 in contact with the sheet P. The endless belt 81 is driven by a belt carrying roller 82, and tension is applied by a tension roller 83. The endless belt 81 is formed to be elongated in the width of the sheet P (direction orthogonal to carrying direction).

The press roller 51 is disposed to face an outer circumferential surface of the endless belt 81, and makes up the pressurizing member that forms a nip 154 for fixing between the press roller 51 and the endless belt 81. The press roller 51 is driven by a motor (not shown), and rotates in an arrow q direction in FIG. 6. The heating member 80 is disposed on an inner circumferential side of the endless belt 81. The press roller 51 is disposed at a position facing the heating member 80 interposing the endless belt 81 therebetween.

The heating member 80 pressurizes the sheet P which is a recording medium from the inner circumferential side of the endless belt 81 interposing the endless belt 81 therebetween in the pressed state. The heating member 80 pressurizes the sheet P to be fixed while the sheet P passes through the nip 154 for fixing between the endless belt 81 and the press roller 51 in the pressed state. The heating member 80 is formed in a long plate shape along the longitudinal direction of the endless belt 81.

In the endless belt 81, for example, a silicone rubber layer having a thickness of 200 μm is formed on an outer side of a polyimide which is a heat resistant resin having a thickness of 70 μm or a SUS base material having a thickness of 50 μm, and an outermost circumference is covered with a surface protective layer such as PFA. In the press roller 51, for example, a silicone sponge layer having a thickness of 5 mm is formed on an iron bar surface of ϕ10 mm, and an outermost circumference is covered with a surface protective layer such as PFA.

In the heating member 80, a grace layer and a heat resistant layer are laminated on a ceramic substrate. The heating member 80 releases extra heat to opposite side of the pressurizing surface (surface abutting on inner circumferential surface of endless belt 81), and aluminum heat sink is bonded to prevent warpage of the substrate. The heat resistant layer is formed of a known material such as $TaSiO_2$, for example, and is divided into a predetermined length and pieces in a main scanning direction (longitudinal direction of endless belt 81).

On the ceramic substrate of the heating member 80, a plurality of heat generation members 84 having a predetermined width are disposed side by side in the main scanning direction. On both end portions of each heat generation member 84, an electrode 85 is formed. Each heat generation member 84 is independently energized by a corresponding drive IC 86. The drive IC 86 which is a switch unit of the heat generation members 84 can be made up by, for example, a switching element, an ETF, a triac, a switching IC, or the like.

Each heat generation member 84 of the heating member 80 (each drive IC 86) is energized and controlled by a main body control circuit (not shown). The main body control circuit selectively energizes, for example, only the heat generation member 84 corresponding to the position where a printing region W (image forming area) of the sheet P to be fixed passes. As a result, the heating member 80 intensively heats only the printing region W on the sheet P interposing the endless belt therebetween. In the main body control circuit, information on the printing region W of the sheet P is input before the sheet P is transported to the fixing device 134.

In at least one embodiment, a lubricant such as a silicone oil is applied to the inner circumferential surface of the endless belt 81 which comes into sliding contact with the heating member 80. A surface layer similar to the above-described embodiment is coated on an outer region in the longitudinal direction and a region straddling a part inside from the outer region in the inner circumferential surface of the endless belt 81. The surface layer is formed of an oil repellent member such as polytetrafluoroethylene (PTFE) or perfluoroalkoxyalkane (PFA). The surface layer is disposed in the vicinity of the longitudinal end portion of a pressurizing surface of the heating member 80 in the inner circumferential surface of the endless belt 81. It is desirable that the surface layer of at least one embodiment also has a trapping portion and an inclined portion similar to the above-described embodiment. The trapping portion traps the lubricant trying to flow out to an outer region from a longitudinal central region of the endless belt 81. The inclined portion pushes the lubricant flowing into the trapping portion back to the longitudinal central side of the endless belt 81 by movement of the endless belt 81 in the rotating direction.

In the fixing device 134, the heating member 80 is pressed against the inner circumferential surface of the endless belt 81 with great power during the fixing operation. Therefore, the lubricant applied to the inner circumferential surface of the endless belt 81 tries to flow out to the longitudinal outer side of the endless belt 81 gradually. In the fixing device 134 of at least one embodiment, a surface layer formed of an oil repellent member is applied to the longitudinal end portion region (vicinity of longitudinal end portion of pressurizing surface of heating member 80) in the inner circumferential surface of the endless belt 81. Accordingly, it is possible to return the lubricant flow out (i.e., the outflow) to the end portion side from the longitudinal central region of the endless belt 81 to the longitudinal central side of the endless belt 81 by the surface layer. Therefore, in the fixing device 134 of at least one embodiment, it is possible to obtain lubricating effect of the lubricant on the inner circumferential surface of the endless belt 81 for a long period of time.

According to at least one embodiment described above, it is possible to suppress the leakage of the lubricant applied to the inner circumferential surface of the rotating member, and maintain a suppression effect of sliding resistance for a long period of time.

While certain embodiments have been described these embodiments have been presented by way of example only, and are not intended to limit the scope of the inventions. Indeed, the novel embodiments described herein may be embodied in a variety of other forms. Furthermore various omissions, substitutions and changes in the form of embodiments described herein may be made without departing from the spirit of the inventions. The accompanying claims and their equivalents are intended to cover such forms or modifications as would fall within the scope and spirit of the invention.

What is claimed is:

1. A fixing device, comprising:

a fixing rotating member configured to fix a toner image on a recording medium, the fixing rotating member having an inner circumferential surface configured to receive lubricant;

a heater configured to heat the fixing rotating member;

a pressurizer disposed to face an outer circumferential surface of the fixing rotating member and to form a nip for fixing between the pressurizer and the fixing rotating member at a position between the pressurizer and the heater;

a surface layer having a first portion continuously formed in a first length along a circumferential surface of the fixing rotating member, and a second portion continuously formed in a second length along the circumferential surface of the fixing rotating member, the first length being longer than the second length, the surface layer being configured to direct lubricant applied to the inner circumferential surface of the fixing rotating member to a longitudinal central side of the fixing rotating member; and a nip pad provided at an inner circumferential side of the fixing rotating member, wherein the first portion is formed in an outer region in a longitudinal end portion of the fixing rotating member, and wherein the outer region is not directly pressed from either the nip pad or the pressurizer.

2. The fixing device of claim 1, wherein the first portion is annular.

3. The fixing device of claim 2, wherein the first length is an entirety of a length of the circumferential surface of the fixing rotating member.

4. The fixing device of claim 1, wherein, in a second direction perpendicular to a first direction, the first direction (i) along the circumferential surface of the fixing rotating member and (ii) parallel to the circumferential surface of the fixing rotating member, the first portion is formed away from where the second portion is formed in the first direction.

5. The fixing device of claim 1, wherein the first portion connects with the second portion.

6. The fixing device of claim 5, wherein the first portion connects with the second portion in a second direction which is perpendicular to a first direction along the circumferential surface of the fixing rotating member.

7. The fixing device of claim 1, wherein the first portion is formed at a distal side of the second portion in a second direction perpendicular to a first direction, the first direction along the circumferential surface of the fixing rotating member.

8. The fixing device of claim 1, wherein a longitudinal length of the nip pad is longer than a longitudinal length of the pressurizer.

9. The fixing device of claim 1, wherein a longitudinal length of the fixing rotating member is longer than a longitudinal length of either of the nip pad or a longitudinal length of the fixing rotating member.

10. A fixing method, comprising:

fixing, by a fixing rotating member, a toner image on a recording medium, the fixing rotating member having an inner circumferential surface configured to receive lubricant;

heating, by a heater, the fixing rotating member;

pressing, by a pressurizer, the fixing rotating member, the pressurizer being disposed to face an outer circumferential surface of the fixing rotating member, and forming, by the pressurizer, a nip for fixing between the pressurizer and the fixing rotating member at a position between the pressurizer and the heater; and causing, by a surface layer, lubricant applied to the inner circumferential surface of the fixing rotating member to be directed to a longitudinal central side of the fixing rotating member, the surface layer having a first portion continuously formed in a first length along a circumferential surface of the fixing rotating member, and a second portion continuously formed in a second length along the circumferential surface of the fixing rotating member, the first length being longer than the second length, wherein a nip pad is provided at an inner circumferential side of the fixing rotating member, wherein the first portion is formed in an outer region in a longitudinal end portion of the fixing rotating member, and wherein the outer region is not directly pressed from either the nip pad or the pressurizer.

11. The fixing method of claim 10, wherein the first portion is annular.

12. The fixing method of claim 11, wherein the first length is an entirety of a length of the circumferential surface of the fixing rotating member.

13. The fixing method of claim 10, wherein, in a second direction perpendicular to a first direction, the first direction (i) along the circumferential surface of the fixing rotating member and (ii) parallel to the circumferential surface of the fixing rotating member, the first portion is formed away from where the second portion is formed in the first direction.

14. The fixing method of claim 10, wherein the first portion connects with the second portion.

15. The fixing method of claim 14, wherein the first portion connects with the second portion in a second direction which is perpendicular to a first direction along the circumferential surface of the fixing rotating member.

16. The fixing method of claim 10, wherein the first portion is formed at a distal side of the second portion in a second direction perpendicular to a first direction, the first direction along the circumferential surface of the fixing rotating member.

17. The fixing method of claim 10, wherein a longitudinal length of the nip pad is longer than a longitudinal length of the pressurizer.

18. The fixing method of claim 10, wherein a longitudinal length of the fixing rotating member is longer than a longitudinal length of either of the nip pad or a longitudinal length of the fixing rotating member.

* * * * *